United States Patent [19]

von Schuckmann et al.

[11] Patent Number: 4,749,106

[45] Date of Patent: Jun. 7, 1988

[54] DISPENSER FOR THE INDIVIDUAL DISPENSING IN PORTIONS OF TABLETS, PASTES OR THE LIKE

[75] Inventors: Alfred von Schuckmann, Kevelaer; Herbert Mettenbrink, Lohne, both of Fed. Rep. of Germany

[73] Assignee: Bramlage Gesellschaft mit beschränkter Haftung, Lohne/Oldenburg, Fed. Rep. of Germany

[21] Appl. No.: 807,615

[22] Filed: Dec. 11, 1985

[30] Foreign Application Priority Data

Dec. 11, 1984 [DE] Fed. Rep. of Germany ..... 3445121
Nov. 30, 1985 [DE] Fed. Rep. of Germany ..... 85115220

[51] Int. Cl.[4] ..... B65D 35/30

[52] U.S. Cl. ..... 812/96; 222/105; 222/153; 222/341; 222/391; 74/130; 221/229; 401/66; 401/84; 401/152

[58] Field of Search ..... 222/95, 103, 105, 153, 222/391, 341, 96; 401/66, 84, 152; 604/210, 214, 224; 206/536, 537; 74/130; 221/228, 229, 279

[56] References Cited

U.S. PATENT DOCUMENTS

| | | | |
|---|---|---|---|
| 1,355,627 | 10/1920 | Tozzi | 401/66 |
| 1,965,271 | 7/1934 | Wharton | 222/95 |
| 2,495,464 | 1/1950 | Lingdell | 222/103 X |
| 2,689,066 | 9/1954 | Budnik | 222/103 |
| 2,935,180 | 5/1960 | von Martens | 206/535 |
| 3,178,076 | 4/1965 | Kennedy | 401/84 X |
| 3,231,139 | 1/1966 | Bouet | 222/95 |
| 3,255,935 | 6/1966 | Spatz . | |
| 4,323,176 | 4/1982 | Sartain | 222/326 |
| 4,437,584 | 3/1984 | Connors et al. | 222/391 X |
| 4,487,341 | 12/1984 | Daykin et al. | 222/391 |

FOREIGN PATENT DOCUMENTS

| | | | |
|---|---|---|---|
| 1959349 | 6/1971 | Fed. Rep. of Germany | 222/391 |
| 2406568 | 8/1974 | Fed. Rep. of Germany | 222/95 |
| 850458 | 9/1939 | France | 222/391 |
| 1570600 | 5/1969 | France | 222/95 |
| 2489267 | 3/1982 | France | 222/391 |
| 33394 | 10/1921 | Norway | 222/391 |

*Primary Examiner*—Joseph J. Rolla
*Assistant Examiner*—Frederick R. Handren
*Attorney, Agent, or Firm*—Martin A. Farber

[57] ABSTRACT

A dispenser for the individual portioned dispensing of tablets (1), pastes or the like, having a housing pipe (2) which is provided at one end with a delivery opening (6) and, opposite same, is equipped with a push bottom (13) for transporting of the material to be dispensed in the direction towards the delivery opening (6), which push bottom (13) can be displaced stepwise in the direction towards the delivery opening by means of an actuating handle which is adjacent the delivery opening and is connected to the push bottom. In order to obtain a favorable accommodation for the material to the dispensed, the bar connection between actuating handle (9) and push bottom (13) extends along the inner surface of the housing pipe wall, leaving the inside of the housing pipe (2) free.

20 Claims, 5 Drawing Sheets

DISPENSER FOR THE INDIVIDUAL DISPENSING IN PORTIONS OF TABLETS, PASTES OR THE LIKE

FIELD AND THE BACKGROUND OF THE INVENTION

The invention referes to a dispenser for the individual portioned dispensary of tablets, pastes or the like, having a housing pipe (tube) which has a delivery opening at one end and, opposite it, is equipped with a push bottom for transporting the material to be dispensed in the direction towards the delivery opening, the push bottom being displaceble stepwise in the direction towards the delivery opening by means of an actuating handle arranged adjacent to the delivery opening or rod and connected by a bar or the like to the push bottom.

A dispenser for the dispensing of pasty material is known from U.S. Pat. No. 3,255,935. In that case, the bar which connects the actuating handle to the push bottom extends centrally within the housing pipe. From French A-850 458 it is known to form the bar of the dispensing mechanism as a rack. However, in this case also the rack has a course which passes centrally through the inside of the pipe housing.

The object of the present invention is so to develop a dispenser of the introductory-mentioned type such that a space-dividing position of the parts which cooperate in forming the dispensing mechanism is avoided, but that nevertheless a manner of operation which delivers the supply in an orderly and reliable fashion is present.

SUMMARY OF THE INVENTION

According to the invention the rod which is connected between the actuating handle (9) and the push bottom (13) extends along an inner surface of the housing pipe wall (W) leaving the inside of the housing pipe (2) free.

As a result of this development there is obtained a dispenser of this type which is of increased value in use. Practically the entire inside cross section of the housing pipe remains free for the material to be dispensed. The means forming the dispensing mechanism are shifted to the periphery. This, first of all, permits the advantage of dispensing bonded particles such as tablets or the like from a housing pipe which corresponds in size to the ordinary tablet tubes. The completely free inner space furthermore makes it possible to use, for instance, refill packings of pasty contents which have a flexible covering. Depending on the size of the dispenser, a single bar connection extending along the inner surface of the housing wall between the actuating handle and push bottom is sufficient so as to leave the inside of the housing free. It is advisable, particularly in the case of larger structures, to provide two racks which extend diametrically opposite each other, act on the push bottom and are longitudinally displaceable by the actuating handle. There is thus obtained a balanced tilt-free displacement of even a very flat push bottom (short piston). It furthermore has proven advantageous for the housing pipe to have a brake which presses laterally against the tablet which is furthest to the front, and for the actuating handle to be formed as an angle-shaped slider, one angle arm of which forms a cover which lies in front of the mouth of the housing pipe, from which slider at least one rack extends in the direction towards the bottom of the housing pipe and is located laterally of the tablet supply space, the rack displacing the push bottom which rests against the last table by ratchet advance by an amount each time equal to the thickness of a tablet, in the direction towards the cover, the cover lifting off from the mouth of the housing pipe by an amount equal to the thickness of a table. The brake which is located on the delivery side holds the next-to-the-last-tablet back in each case. Therefore, in all cases assurance is had that only one tablet drops out. The fact that the slider and the cover form a single part reduces the number of parts. The rack, which is adapted to the ratchet function, passes freely beneath (around) the push bottom, which is displaceable as a function of direction, upon the return movement of the slider. This return movement can be spring-loaded so that the dispenser closes automatically, which leads to a hygienically irreproachable packing. One advantageous development is characterized furthermore by two diametrically opposite longitudinal grooves in the housing pipe wall for guiding the racks. The brake is formed in struturally simple manner as an elastic tongue which is formed on the housing wall. Once advantageous manner of attachment for the slide consists, simply, in the actuating handle, which is made of elastic material, surrounding—seen in cross section—more than one-half of the outer surface of the housing pipe, which is circular in cross section. Furthermore, the invention proposes that longitudinal ribs be provided on the inner wall of the housing for the frictional holding of the push bottom which slides via an outwardly directed collar along these longitudinal ribs. Instead of using a slider as an actuating handle, one can also, in a further advantageous development, form the actuating handle as a forked double-armed lever which is mounted by means of the fork tines on opposite points on the housing pipe and the end region of which lying opposite the actuating-handle button passes through the housing pipe wall and is coupled to the rack. The fork shape of the double-armed lever furthermore results in a favorable snap-on attachment, the coupling points themselves forming at the same time detent projections. Furthermore, it is favorable for the racks to be spring-loaded in the direction of displacement into their basic position. The return thus is obtained automatically. This is achieved by simple means in the manner that the spring loading is transmitted, with the interposition of a ring, onto the end of the racks. Specifically, one can provide the spring loading by the tongues of a ring which acts on the end surface of the racks. It is favorable in this connection for the ring to be formed as on insert of a housing-pipe head cap which is provided at its center with the delivery opening. The inner cover thereof thus forms on abutment for the spring body. Furthermore, an advantageous auxililliary device is created by a locking of the actuating-handle when a closure cap is placed over the dispensing opening. This development can be provided in the manner that the end edge of the closure cap which lies in front of an opening in the cover of the head cap constitues the blocking surface for the upward movement of the rack. On the other hand, the ring can have a finger which engages into the opening of the cover and is blocked in movement by the end edge of the screwable closure cap. The actuating of the dispenser is therefore only possible if the closure cap has been previously removed from the dispenser head. Unintentional dispensing therefore does not occur if the dispenser has been properly closed. Furthermore, the invention proposes that the push bottom be provided on the surface thereof facing the filling space with a pot-shaped depression for the insertion of a closure lead seal for an inner bag containing the material to be dispensed, the gathered wall of which bag emerges at the other end out of the delivery opening of the head cap. For the convenient insertion of a new inner bag into the dispenser so that this dispenser can operate as a reusable dispenser the invention furthermore proposes that the push bottom can be removed from the upper cross section of the housing pipe. Finally, it is also advantageous for the head cap to be formed as threaded member, the thread of which is directed in the direction opposite that of the closure cap. In this way no loosening or unscrewing of the dispenser housing can take place upon the screwing on or off of the closure cap. Finally, it is also advantageous that the ring be attached in non-separatable manner but with axial back-and-forth play, in the head cap.

The object of the invention is explained in further detail below with reference to two embodiments shown in the drawing, in which:

BRIEF DESCRIPTION OF THE DRAWINGS

The other objectives and features of this invention will be apparently understood from the following drawings.

DETAILED DESCRIPTION OF THE PREFERRED EMBODIMENT

Figures 1, 2, 3, 4:
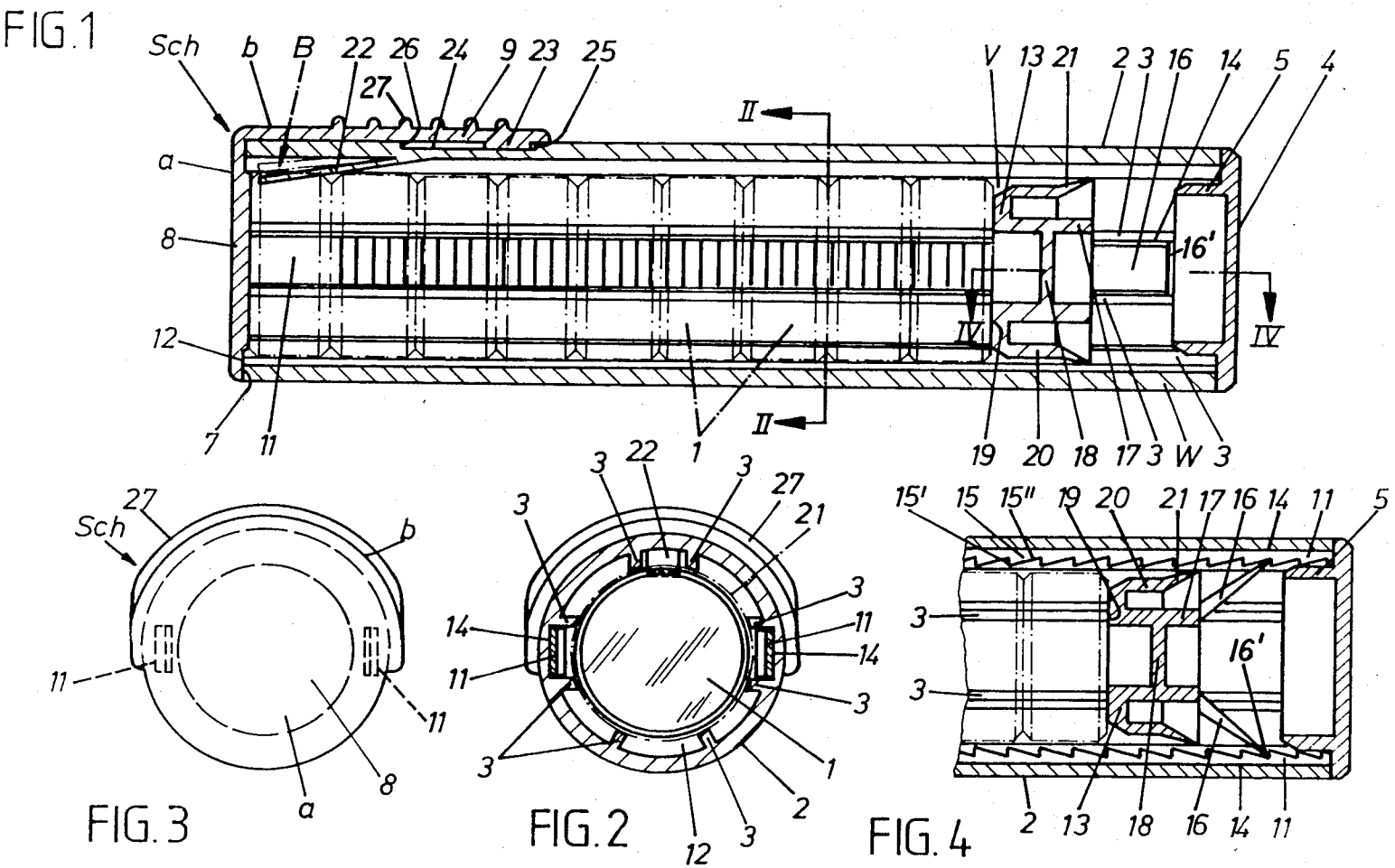
FIG. 1 is a longitudinal section through the dispenser in accordance with the first embodiment, shown in closed position.
FIG. 2 is a section along the line II—II of FIG. 1.
FIG. 3 is an end view of the dispenser, seen from the delivery-side end.
FIG. 4 is a section along the line IV—IV of FIG. 1.
Figure 5:
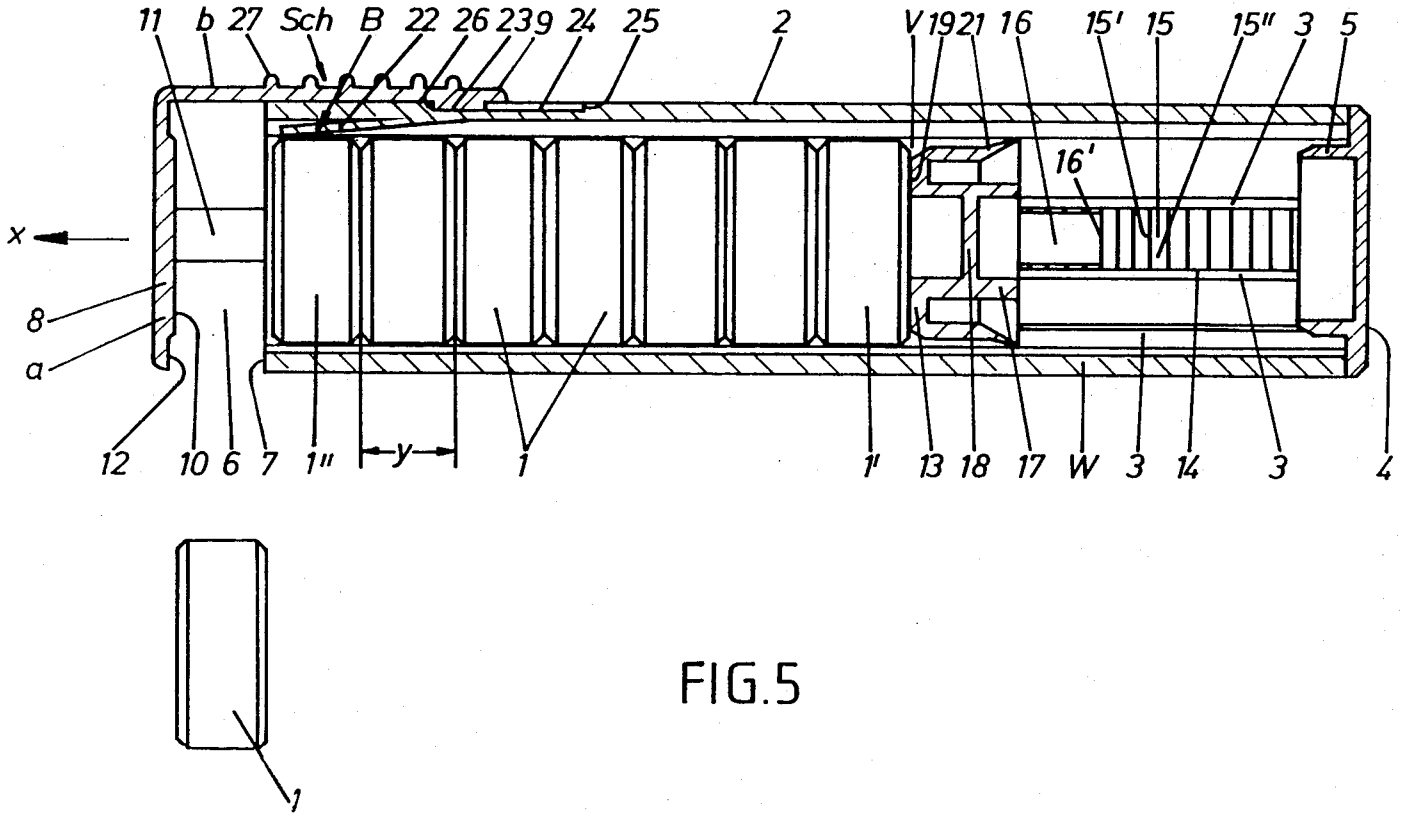
FIG. 5 shows the dispenser in delivery position, again in longitudinal section.

The dispenser shown in FIGS. 1 to 5 is intended for the individual dispensing of tablets 1. It has a housing pipe (tube) 2 of circular cross section. The latter contains the tablets stacked with their broad sides against each other. The cylindrical surface of the tablets is guided on inwardly directed longitudinal ribs 3 which extend from the inner surface of the wall w of the housing pipe.

The right end of the housing pipe 2 can be kept closed by a closure bottom 4 which is inserted in plug-like manner. The closure bottom has an inward-directed collar 5 which is concentrically formed thereon and beveled on its outer edge side, fitting in a force fit in the longitudinal ribs 3.

The other end of the housing pipe 2 forms a transversely directed, open table-delivery cross section. The delivery opening 6 is formed by an axial forward advance (arrow x) of a slider Sch. The slider is of angular shape. Its one angle-arm a forms a cover 8 which comes in closing fashion in front of the mouth 7 of the housing pipe while the other angle-arm b, which extends along the long side of the housing, forms an actuating handle 9.

The inner surface of the cover 8 which faces the tablet supply space V forms a centering projection 10. It is of a flat frustoconical shape which moves over the end edges of the longitudinal ribs.

From the cover 8 of the slider Sch two parallel extending racks 11 extend in the direction towards the bottom of the housing pipe. The racks are formed directly on the cover 8. They are held on the inside of the cover on its annular shoulder 12 which is seated in sealing manner on the housing-pipe mouth 7. The racks 11 extend over the entire length of the housing pipe 2 and cooperate, forming a transport device, with a push bottom 13 which rests against the last tablet 1'. The push bottom is displaced as a function of the displacement of the slider by ratchet advance by in each case the thickness y of one tablet in the direction (arrow x) towards the cover 8, which is lifted off in this manner from the mouth 7 of the housing by an amount equal to the thickness of one tablet.

The racks 11 extend diametrically opposite each other and are guided in longitudinal grooves 14 of the wall W of the housing pipe, the grovoes being formed in each case by two longitudinal ribs 3.

The racks 11 are of sawtooth contour, in the manner that teeth 15 of identical shape have a steep flank 15', i.e. a flank lying in the transverse plane of the housing pipe 2, and an obliquely descending flank 15''. There is a close succession of teeth.

Along the same diameter there extend from the push bottom 13, directed rearward and diverging, ratchet tongues 16, the outer transverse edge 16' of which rests resiliently against the steep flank 15' of the sawteeth 15. The width of the ratchet tongues 16 corresponds essentially to that of the racks 11. As can be noted from FIG. 4, the ratchet tongues 16 are joined in one piece to the end surface of a pot-shaped wall 17 of the push bottom 13, which is otherwise of rotational symmetry. The pot-shaped bottom of the push bottom, which is closed off by a partition wall 18 is extends into an annular push surface 19 of the push bottom. A pot-shaped wall 20 extending in the opposite direction then continues peripherally. The pot wall 20 extends concentrically to the pot wall 17 but, at the level of the transverse partition wall 18, it passes into a diverging collar 21 which is pointed in lip shape. This collar lies with friction locking against the longitudinal ribs 3. This has the result that, upon the closing of the dispenser, the racks 11 move under and relative to the the ratchet tongues 16 and the push bottom 18 retains its position unchanged with respect to the housing 2. Only upon the subsequent stroke in the opposite direction indicated by the arrow x, is the push bottom 13 carried along, thereby pushing the row of tablets further along.

The housing pipe 2 forms a brake B which presses in each time against the frontmost tablet 1''. The brake is formed directly on the inside of the wall W of the housing pipe and acts on the cylindrical wall of the tablet. It is formed of an elastic tongue 22. It can be directly formed thereon or else be formed by slitting a tab on the wall and bending it out at an acute angle. The brake B prevents the next table 1 from slipping or dropping out in the dispensing position shown in FIG. 5, in which the tablet delivery cross section is open on the transverse side. The brake B thus promotes a reliable individualizing of the stack of tablets.

The angle-arm b which forms the actuating handle 9 and extends parallel to the housing pipe 2 is transversely arched, corresponding to the cylindrical shape of the housing pipe 2. It surrounds the outer wall of the housing pipe in form-fitting manner. The amount of surrounding is so selected that the handle 9, which is made of elastic material, surrounds more than half the housing pipe 2. In addition to the support already provided by the rack guides, a snap-on fastening is thereby practically obtained. All parts are made of plastic.

The delivery displacement stroke is limited by a stop. For this purpose, a guide projection 23 extends from the inside of the handle 9. The projection extends into a guide groove 24 whose transversely arranged end flanks 25 and 26 cooperate with the corresponding flanks of the projection 23. The depth of engagement is slight so that the projection can readily be snapped in position by a slight deformation of material. The projection 23 furthermore contributes to the non-rotatable securing of the actuating handle 9. The end flange 25 can relieve the cap 8 from load.

In order to increase the grip on the actuating handle its outer surface is roughened. The roughening consists of transverse ribs 27.

The end regions of the racks 11 on the delivery cross-section side have no teeth.

Briefly summarized, the operation is as follows:

By displacement of the slider Sch via the actuating handle 9 in the direction of arrow x the push bottom 13 and tablets 1 are advanced via the racks 11 and ratchet tongues 16 in the direction indicated by the arrow x. The cap 8 lifts off from the mouth 7 of the housing pipe 2 by an amount which corresponds to the thickness y of a tablet or slightly more than this. The downward facing delivery opening 6 releases the tablet 1. The table 1″ which is then the last one cannot also fall out. This is prevented by the brake B. The orderly stack of tablets is thus moved forward simultaneously with this. No free space is formed between the tablets so that there is no danger of their tipping within such a free space or being abraded or broken.

By pulling the slider Sch back the rack tooth structure 15 passes below relative to the ratchet tongues 16, the push bottom 13 itelf, however, being clamped fast by frictional locking against the ridges of the longitudinal ribs 3.

Figure 6:
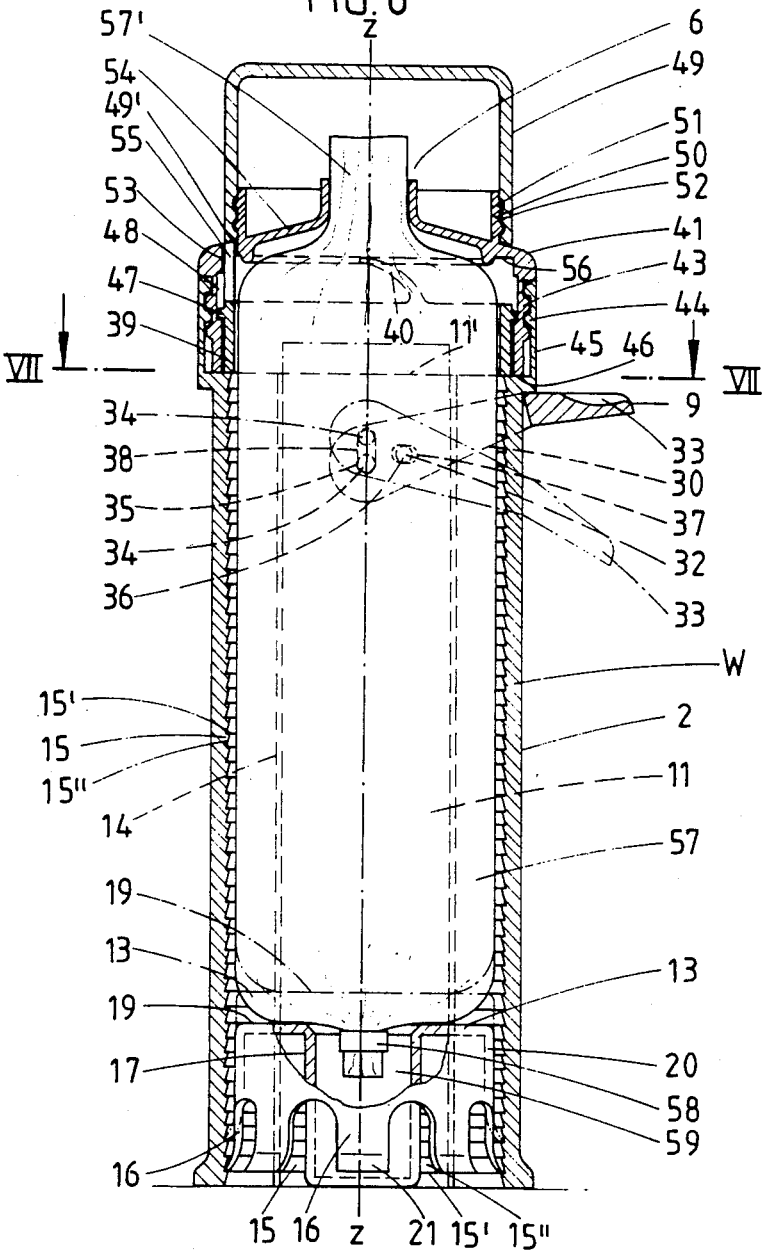
FIG. 6 shows the dispenser of the second embodiment, also in longitudinal section.
Figure 7:
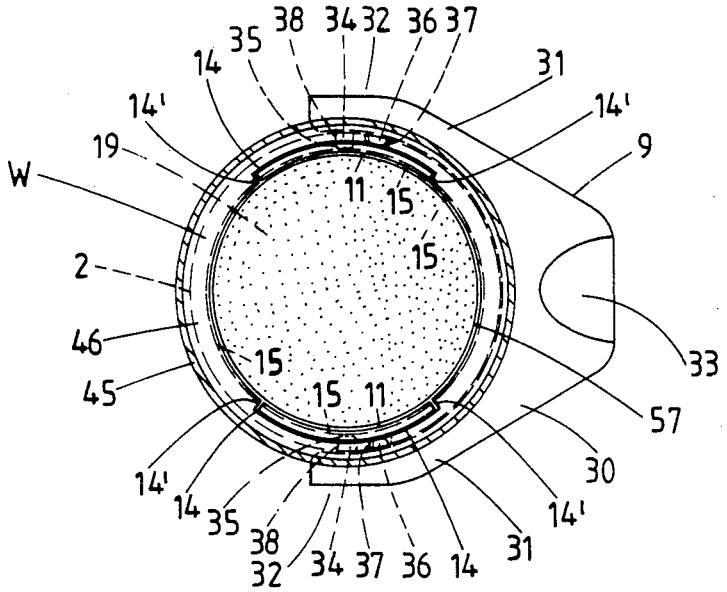
FIG. 7 is a section along the line VII—VII of FIG. 6.
Figure 8:
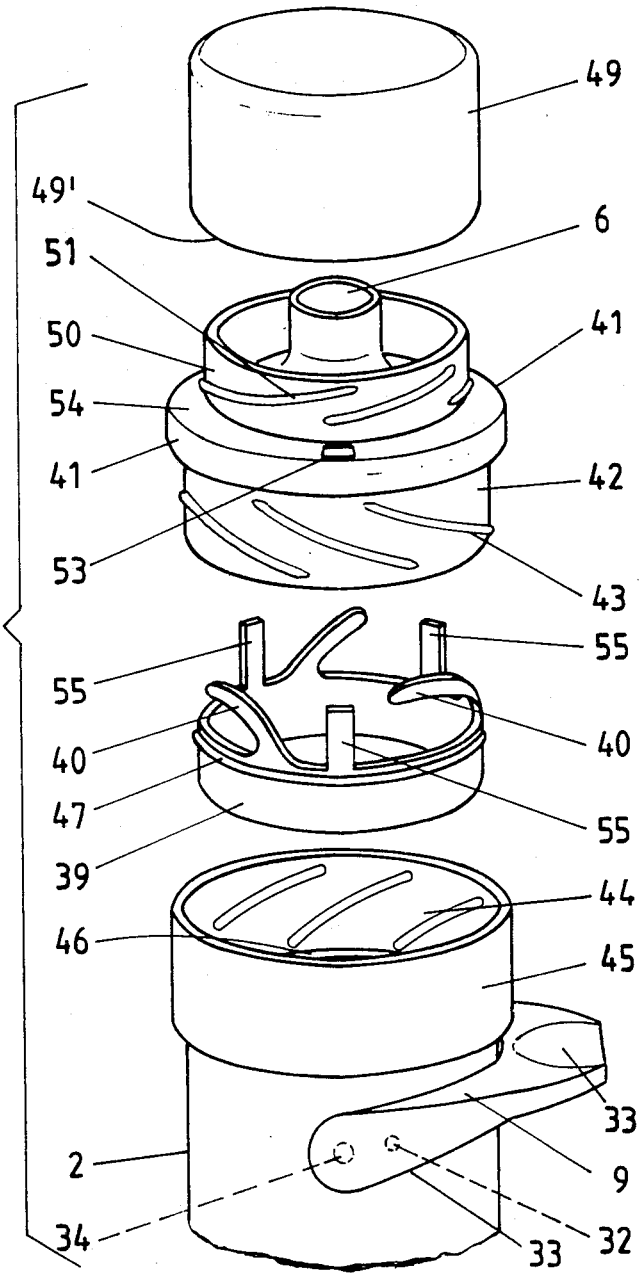
FIG. 8 shows the upper region of this dispenser in an exploded perspective view.

The dispenser of FIGS. 6 to 8 serves for the dispensing of pasty material such as, for instance, toothpaste, mayonnaise, mustard or the like. This dispenser operates in accordance with the same basic principle as has been described in detail above. The reference numbers, insofar as there is correspondence, have been applied accordingly, in part without repetition of the text.

As can be clearly noted, in particular, from FIG. 7, the bar connection between actuating handle 9, which is formed here as a double-armed lever 30, and the push bottom 13 extends also along the inner surface of the wall W of the housing pipe so that here also the inside of the dispenser is free of any parts of the dispenser mechanism. The two racks 11 are in this case recessed in the housing wall W, which has correspondingly deep longitudinal grooves 14 for guiding the racks so that no exposed position is produced with respect to the remaining parts of the inner surface of the pipe housing wall W which have a corresponding toothing character These teeth bear the same reference numbers (15, 15′, 15″).

The width of the racks 11 measured in circumferential direction takes up here an angular region of about 90°. With suitably radially aligned groove flanks 14′ and longitudinal edges of the racks 11 lying closely parallel in front thereof there is obtained a caging of the racks 11. With the push bottom 13 removed, they cannot tip into the iside of the dispenser.

The teeth 15 are formed, here also, as sawteeth, as is the tooth structure on the inner surface of the pipe housing 2. In the basic position, the steep flanks 15′ of the teeth 15 of the racks assume alignment in the same plane as the teeth 15 on the inner surface of the pipe housing 2.

In contradistinction to the push bottom of the first embodiment, the ratchet tongues 16 are now formed by the pot wall 20 or, more precisely, by the obliquely arranged lip-shaped collar 21. The latter is interrupted in tine-like fashion so that individual, radially more movable fingers are present which engage, no longer by friction but by form lock, with respect to the toothed inner surface of the housing 2.

The actuating handle 9, which is formed as a double-armed lever 30, is forked. It surrounds the wall W of the housing pipe. The two correspondingly curved fork tines 31 are mounted on opposite points of the housing pipe 2. The mounting points bear the reference number 32. They lie on the outside the diameter of the housing pipe 2, which is of circular cross section. The end region opposite the laterally protruding actuating handle button 33—namely the shorter arm of the double-armed lever 30—is pivotally connected to the rack or racks 11. This end region of the fork tines 31 engages by means of a pin 34, which is aligned centrally to the longitudinal center axis z—z of the housing pipe, into a suitable mounting cutout 35 in the upper end of the rack there. A second pin 36 of the fork tines 31 which forms the adjacent support point 32 extends within a mounting cutout 37 in the wall of the housing.

For connecting the pins 34 to the racks 11 the wall W of the housing pipe is provided with an opening. The opening, which is formed in the form of a vertical slot 38, can be noted from FIG. 6. The slot determines the range of the angle of swing of the double-armed lever and thus the displacement stroke of the racks 11. The support recess 37 also is of slot shape. However, the slot in this case extends horizontally. It provides a certain freedom of movement for the double-armed lever 30 so that it does not jam in view of the arcuate path of swing of the pins 34 with respect to the vertical slot 38.

The racks 11 are biased by a spring towards their basic position (FIG. 6) For this purpose, a correspondingly amply dimensioned coil compression spring, which can be arranged in the head region of widened cross section of the dispenser, may be used, the spring acting on the upper end 11′ of the racks 11. In the present embodiment, the spring loading is transmitted with the interposition of a ring 39 to the ends 11′. The spring elements are formed directly on said ring 39. They are obliquely arranged tongues 40, the free ends, of which rest, fixed in position, and which press the ring downwards, i.e. in the direction towards the push bottom 13.

The ring 39 is formed as an insert of a head cap 41 which has the delivery opening 6 at its center, the cap being connected to the housing pipe 2. Its shape can be clearly noted from FIG. 8. It is formed as a threaded member. A lower cylindrical collar 42 of reduced cross section bears ribs 43 on its cylindrical surface. This is a multi-start left-handed thread. Their mating ribs 44 are seated on an outwardly offset cylindrical-wall section 45 of the housing pipe 2. The corresponding offset produces a horizontal shoulder 46. The spring-loaded horizontal ends 11′ of the racks 11 extend aligned therewith in the basic position. The lower end edge of the ring 39 rests on this shoulder 46.

In order to secure the ring 39 in the dome-shaped space of the head cap 41 against falling out, an annular bead 47 which is directed outwardly from the upper end edge of the ring 39 engages into a groove 48 extending in axial direction on the inner wall of the collar 42. The axial length of the groove takes into consideration the operating stroke of the dispenser mechanism.

The dispenser is provided with a blocking device which sees to it that the double-armed lever 30 can only be actuated if the delivery opening 6, which is normally closed by a closure cap 49, has been previously opened. This closure cap 49 is screwable. For this purpose the head cap 41 forms an upward-directed second concentrically extending collar 50. On its cylindrical outer surface there are ribs 51 forming a right-hand thread which cooperate with mating ribs 52 or grooves on the inner wall of the closure cap 49. This blocking device is furthermore formed in such a manner that the end edge 49' of the closure cap 49 which rests in front of an opening 53 in the cover 54 of the head cap 41 represents the blocking surface for the upward movement of the racks. One advantageous embodiment resides therein that the ring 39 has a finger 55 which engages into the opening 53 of the cover 54 and is blocked in movement by the end edge 49' of the screwable closure cap 49. In the embodiment shown, three fingers 55, arranged an equal distance apart, are formed on the ring. They extend in the direction of displacement of the ring. In the intermediate regions are the tongues 40 which are guided on the bottom of the cover 54, preferably in an annular channel 56 and rest in protected manner. They extend within the curvature of the said annular channel 56 thereof. When the closure cap 49 has been unscrewed, the obstacle for the axial displacement of the ring 39 is eliminated.

In this embodiment, the material to be dispensed (pasty composition) is contained within an inner bag 57 which can be inserted, after the unscrewing of the head cap 41, into the housing pipe 2. The inner bag has the shape of a "sausage" which is tied off at both ends and therefore has a cylindrical shape which lies, leaving an annular slot, in front of the inner surface of the pipe housing 2 and also spaced in front of the toothing of the racks 11. In order that the so-called "sausage tip," i.e. The end of the inner bag 57 provided with a lead seal 58 is not placed under mechnical stress, the push surface 19 proper of the push bottom 13 which faces the filling space is provided centrally with a depression 59. This depression extends over the entire depth of the pot-shaped part. the other, upper end of the inner bag 57 has its centrally gathered wall 57' passing through the delivery opening 6 of the head cap 41 which is formed by a nipple. This gathered section at the same time forms the delivery mouth. With increasing discharge of the dispensed material, the inner bag 57 presses itself practically in bellows-like manner together, forming radial folds. Practically residue-free dispensing is possible. The top shoulder of the inner bag rests against the inside of the cover 54. The push bottom 13 which is blocked in downward direction can, after emptying, be taken out at the head side of the dispenser. The dimensions of the cross section there take this into consideration. After removal of the pot-shaped push bottom 13, it can be introduced again from the bottom standing edge of the housing pipe 2 after a new full inner bag has been previously introduced.

The operation of this dispenser is as follows: By pushing the button 33 down, the pins 34 pull the racks 11 upward. The push bottom 13 is carried along in this motion via the rack toothing. There is obtained a displacement of the mass present in the inner bag 11 in the direction towards the dispensing opening, the mass emerging outwards via the delivery opening 6, with the upper part of the inner bag being supported on the cover side. The stroke is limited so that a maximum portion is pressed out, which portion, however, may also be reduced. The displacement is effected against the force of the spring element 39/40. After release of the actuating handle 9, the ring 39 pushes the racks back into the starting position. The new position of the push bottom 13 is secured in the manner that it rests against the toothing of the inner surface of the housing pipe 2.

We claim:

1. In a dispenser for the individual portioned delivery of material having a housing pipe which is provided at one end with a delivery opening and, opposite thereto, with a push bottom for transporting of the material in a direction towards the delivery opening, said push bottom being displaceable stepwise in the direction towards the delivery opening by means of an actuating members which is adjacent the delivery, and at least one rod operatively connects the actuating member to the push bottom, the improvement wherein the housing pipe comprises a wall, the rod which is connected between the actuating member and the push bottom extends along an inner surface of the housing pipe wall leaving the inside of the housing pipe free, a bag is disposed inside said housing pipe, said at least one rod comprises two racks extending substantially diametrically opposite each other in said housing pipe, said two racks include ratchet teeth which operatively engage the push bottom, and said two racks are operatively conencted to said actuating member so as to be longitudinally displaceable, said inner surface of the housing pipe wall having sections of ratchet teeth between said racks, each of said racks and said sections being disposed in alternating relationship circumferentially about said inner surface of the housing pipe wall and said push bottom directly engages said ratchet teeth of both of said racks simultaneously and of said inner surface of the housing pipe.

2. The dispenser according to claim 1, wherein said inner surface of said housing pipe wall defines two diametrically opposite longitudinal grooves, said racks are longitudinally displaceably guided in said grooves.

3. The dispenser according to claim 2, wherein said grooves and said racks are arc-shaped, and said ratchet teeth of said sections of said inner surface of said housing pipe wall and said ratchet teeth of said racks are arc-shaped and adjacent each other.

4. The dispenser according to claim 1, wherein said push bottom has an outwardly directed collar means for slidably engaging said housing pipe wall and for holding said push bottom against movement in said housing pipe away from said delivery opening.

5. The dispenser according to claim 1, further comprising a removable closure cap covering said delivery opening, said closure cap forming means for locking said actuating member upon placing said closure cap over said delivery opening.

6. The dispenser according to claim 1 wherein the inside of said housing pipe forms a filling space for the material to be dispensed and has a head cap formed with said delivery opening, said bag is disposed in said filling space and has one end, said bag contains the material, a gathered wall of said bag extending at the other end of the bag out of the delivery opening in the head cap, said push bottom is provided with a pot-shaped depression facing the filling space, and a closure lead seal fixed to said one end of said bag inserted in said pot-shaped depression.

7. The dispenser according to claim 1, wherein an upper section of said housing pipe is formed such that the push bottom is removable from said housing pipe from said upper section of the housing pipe.

8. The dispenser according to claim 1, wherein said push bottom has an obliquely oriented lip-shaped collar edge interrupted peripherally forming a plurality of resilient ratchet fingers engaging said ratchet teeth.

9. The dispenser according to claim 1, wherein said ratchet teeth of said racks and said ratchet teeth of said sections of said inner surface of said housing pipe wall extend completely circumferentially about said inner surface of said housing pipe wall, whereby said bag is confined by the ratchet teeth of the sections of said inner surface of said housing pipe wall.

10. In a dispenser for the individual portioned delivery of material having a housing pipe which is provided at one end with a delivery opening and, opposite thereto, with a push bottom for transporting of the material in a direction towards the delivery opening, said push bottom being displaceable stepwise in the direction towards the delivery opening by means of an actuating member which is located between the ends of the housing pipe adjacent the delivery opening, and at least one rod operatively connects the actuating member to the push bottom, the improvement wherein the housing pipe comprises a wall, and the rod which is connected between the actuating member and the push bottom extends along an inner surface of the housing pipe wall leaving the inside of the housing pipe free, and said actuating member cross sectionally surrounds more than one-half of an outer surface of said housing pipe, the latter being circular in cross section.

11. In a dispenser for the individual portioned delivery of material having a housing pipe which is provided at one end with a delivery opening and, opposite thereto, with a push bottom for transporting of the material in a direction towards the delivery opening, said push bottom being displaceable stepwise in the direction towards the delivery opening by means of an actuating member which is adajcent the delivery opening, and at least one rod operatively connects the actuating member to the push bottom, the improvement wherein the housing pipe comprises a wall, and the rod which is connected between the actuating member and the push bottom extends along an inner surface of the housing pipe wall leaving the inside of the housing pipe free, said at least one rod comprises two racks extending diametrically opposite each other in said housing pipe, said two racks operatively engage the push bottom and are operatively connected to said actuating member so as to be longitudinally displaceable, and said actuating member comprises a forked double-armed lever having fork tines, said lever is mounted via said fork tines at substantially laterally opposite points of the housing pipe, said lever has an actuating-handle button on one side of an imaginary line through said opposite points and end regions on another side of said imaginary line, said end regions pass through said wall and are coupled to said racks.

12. The dispenser according to claim 11, wherein said racks are spring-biased in a direction of displacement into a basic position.

13. The dispenser according to claim 12, further comprising a ring engaging an end of said racks, the spring biasing being transmitted to said racks by said ring.

14. The dispenser according to claim 13, wherein said ring is formed with spring tongues providing said spring biasing, said ring engages an end surface of the racks.

15. The dispenser according to claim 13, further comprising a head cap disposed on the housing pipe, said ring is inserted into said head cap, said head cap at its center forms said delivery opening.

16. The dispenser according to claim 15, further comprising a removable closure cap covering said delivery opening, said closure cap forms means for locking said actuating member upon placing said closure cap over said delivery opening, said head cap has a cover formed with an opening, said closure cap has an end edge located in front of said opening in the cover of said head cap, said end edge comprises said locking means constituting a locking surface for limiting upward movement of said racks.

17. The dispenser according to claim 16, wherein said ring has a finger which engages into said opening in the cover, said finger being blocked in movement by said end edge of said closure cap, the latter being screwable onto said head cap.

18. The dispenser according to claim 17, wherein said closure cap is formed with a thread, and said head cap is threaded to said housing pipe by means of a thread directed in a direction opposite said thread of said closure cap.

19. The dispenser according to claim 15, further comprising means for engaging said ring in non-separatable manner but with axial back and forth play within said head cap.

20. The dispenser according to claim 19, wherein said head cap is formed with an axially extending groove, said engaging means comprises an annular bead formed on said ring engaging in said axially extending groove in said head cap.

* * * * *